United States Patent [19]

Blase

[11] 4,216,061

[45] Aug. 5, 1980

[54] SEALING ARRANGEMENT FOR COKE OVEN DOOR

[75] Inventor: Manfred Blase, Essen, Fed. Rep. of Germany

[73] Assignee: Didier Engineering GmbH, Fed. Rep. of Germany

[21] Appl. No.: 789,717

[22] Filed: Apr. 21, 1977

Related U.S. Application Data

[63] Continuation of Ser. No. 677,850, Apr. 16, 1976, abandoned.

[30] Foreign Application Priority Data

Apr. 22, 1975 [DE] Fed. Rep. of Germany ..... 2517685

[51] Int. Cl.[2] ..... C10B 25/16

[52] U.S. Cl. ..... 202/248; 202/269

[58] Field of Search ..... 202/269, 242, 245, 263, 202/248; 432/242; 34/242; 271/70; 110/173 R, 173 A

[56] References Cited

U.S. PATENT DOCUMENTS

| | | | |
|---|---|---|---|
| 2,038,051 | 4/1936 | Lymn | 202/248 |
| 2,952,454 | 4/1976 | Sudo | 202/248 X |
| 3,162,584 | 12/1964 | Cremer et al. | 202/248 |
| 3,957,591 | 5/1976 | Riechker | 202/263 |
| 4,016,046 | 4/1977 | Van Ackeren | 202/248 |

FOREIGN PATENT DOCUMENTS

| | | | |
|---|---|---|---|
| 1156762 | 11/1963 | Fed. Rep. of Germany | 202/248 |

*Primary Examiner*—Arnold Turk

*Attorney, Agent, or Firm*—Wenderoth, Lind & Ponack

[57] ABSTRACT

A coke oven door, which is positioned within a door frame in a closed position, has inner and outer sealing strips which contact the door frame. The two sealing strips jointly form a gas guide duct with the door frame. The inner sealing strip forms an elastic and flexible seal which prevents solids from passing into the guide duct but which allows gas to pass thereto. The outer sealing strip forms a gas-tight nonflexible seal.

5 Claims, 4 Drawing Figures

SEALING ARRANGEMENT FOR COKE OVEN DOOR

This is a continuation of application Ser. No. 677,850, filed Apr. 16, 1976, now abandoned.

BACKGROUND OF THE INVENTION

The present invention relates to a sealing arrangement for a coke oven door, and particularly such an arrangement including an inner sealing strip that seals against solids and an outer gastight sealing strip. Such sealing strips, when in the sealing position, define jointly with the door frame a guide duct for removing the gases leaving the over chamber, the guide duct being under a lower pressure than the oven chamber in the area of the coal pile or charge therein.

A sealing arrangement of this type is shown in German Utility Model No. 1,897,929 wherein the inner sealing strip is welded in the form of a rigid half-round rib on the side walls of the door plug, so that the vertex of such rib is positioned at a small distance from the frame jamb of the door opening. An edge of the outer sealing strip contacts an outwardly facing sealing surface of the door frame. Small dimension tolerances are required in such an arrangement, since the exact position of the sealing strips in relation to each other and in relation to the door frame, as well as the degree of wear of the sealing edge of the outer sealing strip, are determinative of the width of the gap between the vertex of the inner sealing strip and the frame jamb. Due to the position and shape of the inner sealing strip, the passage of gas into the guide duct is impeded by dirt, and thus the mobility of the coke oven door is hindered.

SUMMARY OF THE INVENTION

An object of the present invention is to eliminate the above disadvantages while providing a coke oven door sealing arrangement of the above type which, with relatively low expenditure, provides a reliable and lasting seal, and with which the removal of gas is effective during the entire operational period.

It is a further object of the invention to provide such an arrangement without the necessity of having to accurately adjust the position and dimensions of the two sealing strips in relation to each other.

These objects are achieved by providing that the inner sealing strip contacts the door frame in an elastic and flexible manner and that the outer sealing strip contacts the door frame in a nonelastic manner. Due to this arrangement, the outer sealing strip forms a firm, gastight abutment when the coke oven door is closed, and the inner sealing strip contacts the door frame in an elastic sealing manner, without the necessity of having to specifically adjust the exact reciprocal positions of the sealing edges of the two sealing strips.

The inner sealing strip is preferably angular in shape, and in a preferred embodiment it is Z-shaped. Due to this angular configuration, an elastic sealing effect is obtained, even when relatively rigid material is used.

The outer sealing strip may be flat in shape and have a vertically extending sealing edge contacting a sealing surface of the door frame. Due to this configuration, a nonflexible and rigid sealing effect is obtained, even when a relatively flexible material is used.

In a relatively simple embodiment of the invention, the two sealing strips contact each other at areas thereof spaced from their respective edges which contact the sealing surfaces of the door frame. In such embodiment, the two sealing strips are attached to the coke oven door at the areas of mutual contact.

Preferably, the two sealing strips are components of a single structural element.

In an advantageous embodiment, the guide duct is obtained in such a manner that the two sealing strips, when in the sealing position of the coke oven door, contact separate sealing surfaces of the door frame situated in separate planes.

The sealing strips preferably contact outwardly facing sealing surfaces of the door frame, in order to maintain soiling of the sealing surfaces at a low level, to make it possible to easily clean the duct and strips, and in order to avoid any detrimental effect on the mobility of the coke oven door. If the inner sealing strip contacts an obliquely outwardly facing sealing surface of the door frame, the elastic flexible property of the inner sealing strip can be utilized in a very simple manner.

The inner sealing strip consists with advantage of an elastic and flexible material.

The outer sealing strip may include a band of material such as asbestos or the like, which makes contact in a firm and sealing manner with the door frame.

BRIEF DESCRIPTION OF THE DRAWINGS

Other objects and features of the present invention will become apparent from the following description, taken with the accompanying drawings, wherein.

DETAILED DESCRIPTION OF THE INVENTION

Figure 1:
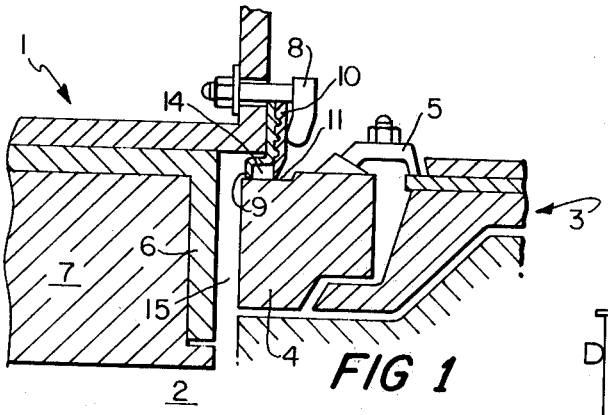
FIGS. 1, 2 and 3 are cross sectional views of respective first, second and third embodiments of the invention.

A coke oven door 1 closes an oven chamber 2 of a coke oven. A door frame 4 is attached to a wall protecting plate 3 of oven chamber 2 by means of clamping elements 5.

Coke oven door 1 is pressed from the outside against door frame 4 by means of a locking device that may be conventional and thus is not shown in the drawings. Door 1 includes holding elements 6 supporting and receiving a door plug 7.

An inner sealing strip 9 and an outer sealing strip 10 are attached to coke oven door 1 by means such as the illustrated eccentric bolts 8 or clamping bolts. Inner sealing strip 9 is Z-shaped in lateral cross-section. One arm of Z-shaped sealing strip 9 contacts outer sealing strip 10. The edge of the other arm of Z-shaped sealing strip 9 and the edge of outer sealing strip 10 contact, according to the embodiment of FIG. 1, a common outwardly facing sealing surface 11 of door frame 4. In the embodiments of FIGS. 2 and 3, separate sealing surfaces 12 and 13 are provided for each of sealing strip 9 and 10, respectively. Sealing surfaces 12 and 13 are situated in different planes of door frame 4, and sealing surface 12 of the embodiment of FIG. 3 is aligned obliquely outwardly.

Inner sealing strip 9 consists of an elastic material, preferably a suitable metal, and its seal with surfaces 11 or 12 is not gastight. Rather, strip 9 need merely prevent the penetration of coal into a guide duct 14 formed between sealing strips 9 and 10. Outer sealing strip 10 seals guide duct 14 in gastight manner in relation to the surrounding space and is preferably formed of metal. However, strip 10 may also be formed of other nonflexible heat-resistant materials such as asbestos, for example.

A gap 15 exists between brick holder 6, or door plug 7, and door frame 4, or wall protecting plate 3. The dimensions of gap 15 are such that it is possible to move coke oven door 1 before and after the coking operation.

The operation and function of the above described sealing arrangement will now be described.

When coke oven door 1 is closed, outer sealing strip 10 is placed in nonflexible gastight sealing contact against respective sealing surface 11 or 13. Elastic flexible inner sealing strip 9 is placed against respective sealing surface 11 or 12 in a manner such that it automatically provides a seal against the penetration of solids into duct 14.

Figure 4:
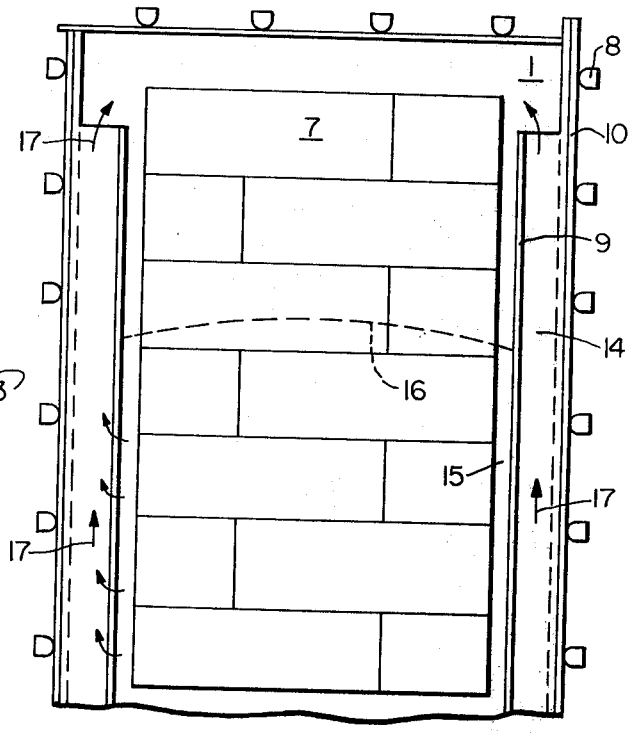
FIG. 4 is a schematic view from the interior of a chamber toward the chamber door, sealed according to the invention.

When coke oven chamber 2, thereby closed by means of door 1, is filled with coal, for instance with a coal pile or charge as shown at 16 in FIG. 4, the coal will extend into gaps 15 on opposite sides of door 1. However, inner sealing strips 9 prevent the penetration of coal into respective guide ducts 14, and thus obstruction of the ducts 14 are prevented. The high pressure gas generated in oven chamber 2 adjacent gaps 15 during the coking operation escapes through inner sealing strips 9 into respective guide ducts 14. Such gas passes upwardly through guide ducts 14 are generally shown by arrows 17, and is led off through risers and gas collecting mains (not shown) which are maintained at a relatively lower pressure. Thus, the natural pressure gradient of the overall installation is utilized, along with outer sealing strips 10 to prevent the escape of the gas from ducts 14. The inner sealing strip 9 has an elasticity, flexibility and configural shape such that, upon an increase of the gas pressure within the oven chamber 2 and the gap 15, the inner sealing strip 9 is urged with an increased force against the door frame surface 11 or 12. This reduces the amount of the high pressure gas entering through the inner sealing strip 9 into the guide duct 14, and thereby additionally reduces the pressure within the guide duct which acts on the outer sealing strip 10. In other words, as shown in all of the illustrated embodiments, the inner sealing strip 9 has a substantially Z-shaped transverse cross-sectional configuration, including a transverse web which extends inwardly toward gap 15. Accordingly, the gas pressure in oven chamber 2 and gap 15 always act on the interior surfaces of the inner sealing strip 9 in a manner such as to force the inner sealing strip 9 more firmly against the door frame.

After coke oven door 1 is opened, sealing strips 9 and 10 and guide ducts 14 can be cleaned in a simple manner since the ducts 14 are completely open when the door is in this position.

Figure 2:
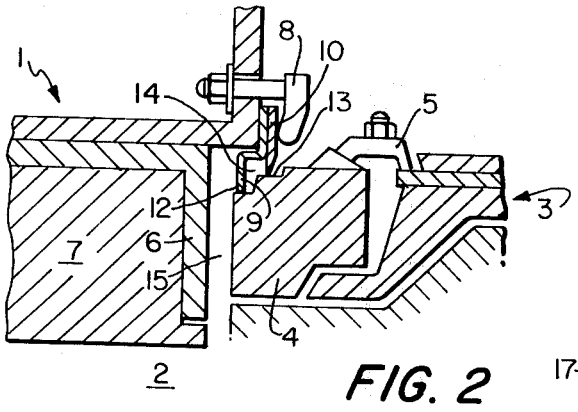
Figure 3:
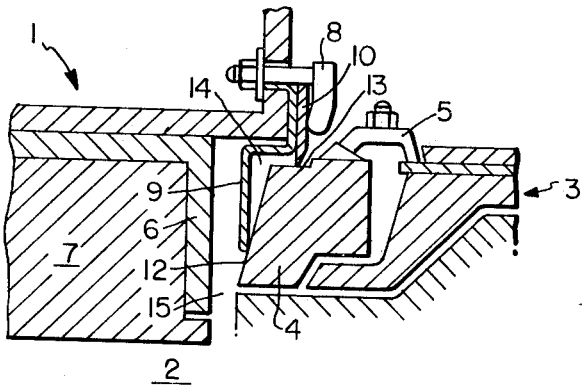

It can be seen from the described embodiments of FIGS. 1–3 that the cross-sectional configuration of guide ducts 14 can be dimensioned within wide limits to provide maximum effectiveness of removing through the ducts 14 the gas volume generated adjacent gaps 15.

It will be apparent that numerous further embodiments of the specific seal construction are to be considered to be within the scope of the invention. For example, outer sealing strip 10 may have other shapes that contribute to the cross-sectional configuration of the guide duct. In particular, strip 10 may be Z-shaped similar to the shape of strip 9.

What is claimed is:

1. A coke oven door sealing arrangement comprising:

a door frame mounted within an oven chamber containing therein coal and generating therein high pressure gas during coking of the coil;

a coke oven door positionable in a closed position within said door frame with gaps between said door and said door frame;

inner sealing strip means, attached to said door, for contacting said door frame when said door is in said closed position to form an elastic and flexible inner seal allowing passage therethrough of said high pressure gas but preventing passage therethrough of said coal;

outer sealing strip means, attached to said door, for contacting said door when said door is in said closed position to form a nonflexible gas-tight outer seal preventing passage therethrough of said gas, said outer sealing strip means comprising a flat planar member extending substantially perpendicular to said door frame and having a vertically extending edge contacting said door frame;

said inner and outer sealing strip means, at areas thereof spaced from contact with said door frame, being in contact with each other and being attached to said coke oven door;

said inner and outer seals and said door frame defining therebetween a longitudinal guide duct into which passes said gas through said inner seal, said inner seal extending vertically upwardly and terminating at a position substantially above the upper level of the coal in said oven chamber, said guide duct thereby being open at the upper end thereof;

said inner sealing strip means being formed of an elastic material and having an angular transverse cross-sectional configuration and a vertically extending edge contacting said door frame in such a manner that, upon an increase of the gas pressure within said oven chamber, said elastic inner sealing strip means is urged by such increased gas pressure against said door frame with increased force, thus reducing the amount of said gas entering said guide duct and thereby reducing the pressure within said guide duct acting on said outer sealing strip means; and said guide duct being in gas flow communication with to risers and gas mains of the coke oven, maintained at a pressure lower than the gas pressure within said guide duct, for removing said gas from said guide duct, longitudinally thereof, during normal coking operation of said oven chamber.

2. An arrangement as claimed in claim 1, wherein said inner sealing strip means has a Z-shaped transverse cross-sectional configuration.

3. An arrangement as claimed in claim 1, wherein said inner and outer sealing strip means contact separate sealing surfaces of said door frame located in different planes.

4. An arrangement as claimed in claim 1, wherein said inner and outer sealing strip means contact outwardly facing sealing surfaces of said door frame.

5. An arrangement as claimed in claim 1, wherein said inner sealing strip means contacts an obliquely outwardly facing sealing surface of said door frame.

* * * * *